US011117173B2

(12) United States Patent
Wendt et al.

(10) Patent No.: US 11,117,173 B2
(45) Date of Patent: Sep. 14, 2021

(54) QUICK-ACTION ADJUSTMENT FOR ADJUSTING CYLINDER IN EDGING STANDS

(71) Applicant: SMS GROUP GMBH, Düsseldorf (DE)

(72) Inventors: Stefan Wendt, Hilchenbach (DE); Martin Schmidt, Hilchenbach (DE); Michael Zielenbach, Siegen (DE)

(73) Assignee: SMS GROUP GMBH, Düsseldorf (DE)

( * ) Notice: Subject to any disclaimer, the term of this patent is extended or adjusted under 35 U.S.C. 154(b) by 293 days.

(21) Appl. No.: 16/462,807

(22) PCT Filed: Nov. 10, 2017

(86) PCT No.: PCT/DE2017/100952
§ 371 (c)(1),
(2) Date: May 21, 2019

(87) PCT Pub. No.: WO2018/095465
PCT Pub. Date: May 31, 2018

(65) Prior Publication Data

US 2021/0170459 A1 Jun. 10, 2021

(30) Foreign Application Priority Data

Nov. 22, 2016 (DE) ..... 10 2016 122 521.5

(51) Int. Cl.
*B21B 13/06* (2006.01)
*B21B 31/22* (2006.01)
(Continued)

(52) U.S. Cl.
CPC ..... *B21B 13/06* (2013.01); *B21B 31/22* (2013.01); *B21B 31/203* (2013.01); *B21B 37/62* (2013.01);
(Continued)

(58) Field of Classification Search
CPC ..... B21B 13/06; B21B 31/32; B21B 37/62; F15B 11/032
(Continued)

(56) References Cited

FOREIGN PATENT DOCUMENTS

EP 1687104 B1 12/2008
EP 2265395 B1 3/2013
(Continued)

OTHER PUBLICATIONS

Yoshimatsu, Translation of JPH05248405 (Year: 1993).*
(Continued)

*Primary Examiner* — Adam J Eiseman
*Assistant Examiner* — Bobby Yeonjin Kim
(74) *Attorney, Agent, or Firm* — Henry M. Feiereisen LLC

(57) ABSTRACT

An adjusting cylinder quick-action adjustment for a long, rapid stroke movement in an edging stand which includes an edger upright, adjustment system, balancing system and edging roll sets, comprises a piston which acts via edging roll chocks of at least one edging roll for adjustment against the rolling stock. The adjustment of the edging roll can be actuated on each side hydraulically by a fluid. The adjusting cylinder quick-action adjustment is mounted in the edger upright and exerts the force required for the edging process. The adjusting cylinder quick-action adjustment includes on each side of the edging upright at least one double cylinder which has two cylinders coupled to one another and is separately controllable and configured for rapid adjustment and for control adjustment of the edging roll.

19 Claims, 4 Drawing Sheets

(51) Int. Cl.
*B21B 38/00* (2006.01)
*B21B 37/62* (2006.01)
*B21B 31/20* (2006.01)

(52) U.S. Cl.
CPC ..... *B21B 38/00* (2013.01); *B21B 2203/18* (2013.01); *B21B 2265/12* (2013.01)

(58) Field of Classification Search
USPC ..... 72/199–252.5, 453.01, 453.02; 92/169.1
See application file for complete search history.

(56) References Cited

FOREIGN PATENT DOCUMENTS

| | | | | | |
|---|---|---|---|---|---|
| EP | 2411165 | B1 | | 4/2014 | |
| JP | S59220205 | A | | 12/1984 | |
| JP | S60129407 | A | * | 7/1985 | ..... B21B 31/32 |
| JP | S60129407 | A | | 7/1985 | |
| JP | H05248405 | A | * | 9/1993 | ..... B21B 31/32 |

OTHER PUBLICATIONS

Matsushita, Translation of JPS60129407 (Year: 1985).*
International Search Report issued by the European Patent Office in International Application PCT/DE2017/100952.

* cited by examiner

QUICK-ACTION ADJUSTMENT FOR ADJUSTING CYLINDER IN EDGING STANDS

CROSS-REFERENCES TO RELATED APPLICATIONS

This application is the U.S. National Stage of International Application No. PCT/DE2017/100952, filed Nov. 10, 2017, which designated the United States and has been published as International Publication No. WO 2018/095456 and which claims the priority of German Patent Application, Serial No. 10 2016 122 521.5, filed Nov. 22, 2016, pursuant to 35 U.S.C. 119(a)-(d).

BACKGROUND OF THE INVENTION

The invention relates to an adjusting cylinder quick-action adjustment for long, rapid stroke movements in edging stands, at least including an edger upright, adjustment system, balancing system and edging roll sets, including each at least a piston which acts via edging roll chocks of at least one edging roll for adjustment against the rolling stock on both sides and wherein the adjustment of the edging roll can be actuated on each side hydraulically by a fluid and the adjusting cylinder quick-action adjustment is mounted in the edger upright and exerts the force required for the edging process.

The adjustment device in edging stands has the objective to adjust, maintain and, optionally, to control the necessary roll gap. In this context, the terms rapid adjustment and control adjustment are used. The rapid adjustment provides the rapid opening or closing of the roll gap. The control adjustment relates to the adjustment by which ultimately the rolling force is transferred with the roll gap that has been adjusted beforehand by the rapid adjustment, upon the rolling stock. The control adjustment maintains the roll gap constant within the scope of a predefined value range. The system is held clearance-free solely via an edging roll balancing, i.e. there is no clearance between the edging roll chock, cylinder head, and the cylinder piston.

Adjusting devices are known in edging stands as purely mechanical adjustment, as purely hydraulic adjustment, or as a combination of mechanical and hydraulic adjustment. Technically possible and appropriate is the arrangement of one or two adjustments per side.

Known, for example, is a purely hydraulic adjusting device in edging stands in the roughing stand edger of a hot-strip rolling mill. This adjusting device is realized as a conventional differential cylinder comprised of piston, cylinder cover, and cylinder base.

However, this design has limits both in the necessary fluid demand and thus the travel rate and in the transverse force sensitivity when the piston rod is fully extended.

Document EP 1 687 104 B1 discloses to equip the adjusting cylinder with a second piston rod, so that each adjusting cylinder has a piston which is equipped with two piston rods that point in opposite directions, and the piston is placed in a recess in the cylinder base or cylinder cover, with these having coaxially arranged bores for passage of the piston rods. This solution has, however, the drawback of requiring a very high pump output for the necessary operating speeds.

Document EP 2 411 165 B1 discloses an apparatus for edge rolling of metal plates. This apparatus includes a roll that is mounted to a block, at least one edge-treating hydraulic cylinder with a relatively large working area, with at least one further hydraulic cylinder being provided and having a relatively small working area, and each cylinder includes an associated piston, with the pistons being mechanically coupled such that a movement of one piston causes a movement of the other piston. The apparatus requires a formfitting, and for purposes of possible maintenance detachably connection between adjustment, balance cylinder, and balance crossbeam. This may cause time and again leakages at the connecting points. Furthermore, inadmissibly high radial forces may act upon the cylinder piston and may cause damage to the piston rod and further guide elements. This, in turn, leads again in additional leaks.

Document EP 2 265 395 B1 further discloses a type of telescopic cylinder having two oil columns connected in series and acting on the rolling stock. The entire adjustment path can be traveled only by using both oil columns.

Further known are adjusting cylinders in edging stands (AWC cylinder) in a so-called follower control circuit. These are very complex in terms of control and must be maintained in synchronism by additional valves.

In particular when edging stands with great opening width of the adjusting systems are involved, such as, for example, required in plate-rolling mills, adjusting systems are demanded which travel at a very high adjustment speed of approx. 150 mm/sec. The entire adjusting stroke should hereby be traveled within a short time interval of approx. 15 sec. This is necessary, for example, in terms of process, since the ingots in plate-rolling mills are turned on an upstream rotary roller table to produce the necessary great width. In this way, a slender ingot, as viewed in rolling direction, becomes very wide, as viewed in rolling direction, through turning on the rotary roller table.

To date, this rapid adjustment speed of the adjustment is realized by a mechanical adjustment with electro-mechanic drive and pneumatic brake. The mechanical adjustment implements hereby the rough adjustment of the adjusting system. A fine adjustment is normally necessary in addition to the mechanical adjustment and is realized as hydraulic short-stroke adjustment and responsible for the control operation with automatic width control and short-stroke control for reducing crop loss.

In this known system of mechanical/hydraulic adjustment, the elimination of the mechanical adjustment and the construction of the adjusting system as purely hydraulic long-stroke adjustment has not been economically viable to date, because it was not possible to realize the necessary high adjustment speeds without the provision of high pump capacities and at the same time a simple configuration of the hydraulic long-stroke adjustment.

It is, therefore, an object of the present invention to provide a rapid adjustment within a compact system of hydraulic cylinders, without the necessity to construct the fluid pump station unnecessarily large. Even in edging stands with smaller opening widths, as typical for example in hot strip assembly lines, the present invention is able to contribute to a relief of the pump station. To date, this has been implemented by the so-called follower control circuit.

SUMMARY OF THE INVENTION

This object is achieved by an adjusting cylinder quick-action adjustment which includes on each side of the edging upright at least one double cylinder, with the double cylinder comprised of two cylinders which are coupled to one another and separately controllable and configured for rapid adjustment on one hand, and for control adjustment of the edging roll on the other hand.

In this way, it becomes possible to realize a reliable rapid adjustment of adjusting cylinders in particular in an edging stand by using a purely hydraulic adjusting system, comprised of the adjusting cylinder quick-action adjustment according to the invention. This is of advantage in cases in which a long and at the same time rapid cylinder stroke is demanded, which otherwise requires high capacities in terms of the pump outputs of the hydraulic system. Further, the need for additional control elements like the mechanical adjustment with the pertaining electric components (displacement pick-up, limit switch, adjustment motor and respective feeds) is eliminated. Furthermore, the use of double cylinders lowers energy consumption, which again increases cost-efficiency of the overall edging stand.

According to an advantageous embodiment of the adjusting cylinder quick-action adjustment, provision can be made to connect the cylinder piston of the rapid adjustment and the housing of the control adjustment with the same fixed bank of the edger upright and in addition to configure the housing of the rapid adjustment in one piece with the piston rod of the control adjustment. In this case, the term bank is to be understood as an abutment for support of forces caused by the adjusting cylinder quick-action adjustment and the control adjustment and ultimately transmitted via the edging rolls onto the rolling stock. In the present case, the bank may include the edger upright with crosshead and the upper and lower edger bars.

In a multipart embodiment of the adjusting cylinder quick-action adjustment according to the invention, the cylinder piston of the rapid adjustment can be connected with the cylinder piston of the control adjustment, whereas the housing of the rapid adjustment can be connected with the same fixed bank of the housing of the control adjustment.

According to another multipart embodiment of the adjusting cylinder quick-action adjustment according to the invention, the cylinder housing of the rapid adjustment is connected with the piston rod of the control adjustment, whereas the cylinder piston of the rapid adjustment is connected with the same fixed bank of the housing of the control adjustment.

According to a further preferred embodiment, the rapid adjustment and the control adjustment can be configured for separate activation from one another and the movement of the housing of the rapid adjustment or of the cylinder piston, as triggered by the activation, then causes the movement of the cylinder piston of the control adjustment. Provision is further made for the cylinder pistons of the rapid adjustment and the control adjustment to have the same stroke travel.

According to an advantageous embodiment, the rapid adjustment has, compared to the control adjustment, a greater adjustment speed which can be greater by a multiple as a result of the surface ratios of the cylinder pistons between rapid adjustment and control adjustment at same volumetric flow rate of the fluid in relation to the control adjustment, and which applies via the control adjustment the required rolling force upon the edging roll.

According to a further particularly advantageous embodiment, provision can be made for the displaced hydraulic fluid volume to be conducted in the non-active part of the double cylinder during the adjusting movement into the respectively other cylinder chamber, wherein possibly lacking fluid volume can be replenished into the hydraulic system and excess fluid volume can be drained. For this purpose, provision can be made for a storage container or a compensating container.

Provision may also be made for the cylinder piston of the control adjustment of the double cylinder to be configured as a piston and two piston rods pointing in opposite directions. The oppositely pointing piston rods of the control adjustment of the double cylinder can hereby have the same diameter. The cylinder piston of the rapid adjustment of the double cylinder can be configured as a piston with two piston rods pointing in opposite directions. The oppositely pointing piston rods of the rapid adjustment of the double cylinder can also have the same diameter.

It is provided that in the presence of two or more adjustments per side, only one adjustment per side is configured as double cylinder, wherein the further adjustments that are not configured as double cylinder are configured as control adjustments and via which the respectively displaced fluid volume can be driven during travel of the cylinder.

According to a particularly advantageous embodiment of the present invention, the cylinders of the double cylinder are structurally interleaved within one another. In this way, a compact and space-saving construction can be realized. This is of advantage in particular when existing edging rolling mills are modified on the job site because of the creation of added space.

It is advantageous when the piston of the control adjustment forms the housing of the rapid adjustment. This contributes to a very compact, self-contained construction of a thus-formed piston and cylinder unit, comprised of the rapid adjustment and the control adjustment connected thereto. Further, a cylinder head is associated to the control adjustment and is able to reduce the radial forces upon the adjustment from the leading pass impact. Also the cylinder pistons can be equipped with an anti-rotation mechanism.

It is advantageous, when associating to each adjustment a distance measuring system. In this way, precise travel conditions can be established.

In order to improve the adjustment of the edging rolls, it is advantageous when the travel paths of the control adjustments on one side are synchronized in terms of control, so that the stroke for the individual control adjustments of one side can be configured of a same size in the edging stand per side. This means that the stroke of the control adjustments of one side shall be of same size. On the other hand, this can also mean that both sides need not necessarily have the same stroke.

The controls of the individual adjustments per side of the double cylinders and the further possible adjustments can be combined in a control unit and activated by the latter.

It is advantageous when the respective cylinders of the double cylinder (rapid adjustment and control adjustment) can be activated by separately operating valves. As a result, the operating states can be individually coordinated in the double cylinders. The used and installed control valves in the hydraulic system can hereby be configured as servo valves or proportional valves or directional control valves.

According to a particularly advantageous embodiment of the adjusting cylinder quick-action adjustment, the control of the adjustments can be connected or provided with follower control circuits. In this way, a particularly well synchronized pre-positioning of the adjustments of one side can be achieved.

BRIEF DESCRIPTION OF THE DRAWING

The invention will now be described in greater detail with reference to an exemplified embodiment. It is shown in.

DETAILED DESCRIPTION OF PREFERRED EMBODIMENTS

Figure 1:
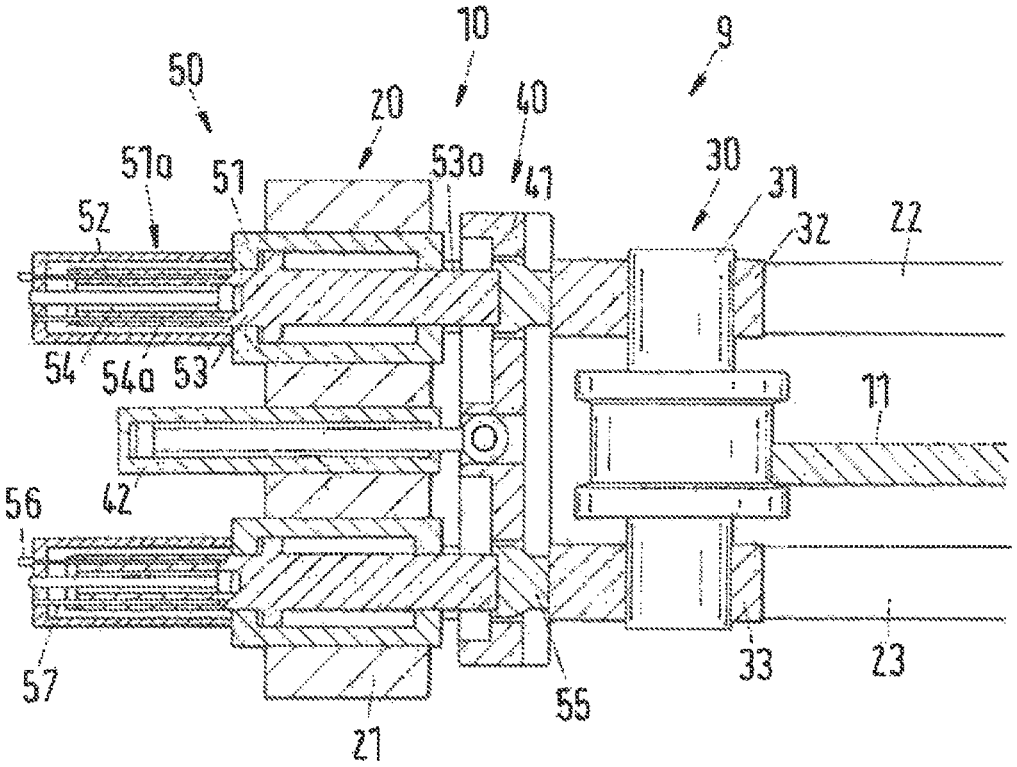
FIG. 1 the schematic illustration or an edger by way of a partial sectional view with the adjusting cylinder quick-action adjustment with two double cylinders for the rapid adjustment and the control adjustment.

As shown in FIG. 1, the adjusting cylinder quick-action adjustment 9 according to the invention is formed as an integral part of an edger 10. The edger 10 is provided to edge the edges of a rolling stock 11 entering the edger 10 in order to deliberately influence the width of the entering rolling stock 11 during the ongoing rolling process. For this purpose, the edger 10 includes on one side at least one edger upright 20 which is connected with an edger crosshead 21.

Furthermore, provision is made for upper and lower edger bars 22 and 23. An adjoining edging roll unit 30 essentially includes upper and lower edging roll chocks 32 and 33 in which an edging roll 31 is rotatably mounted.

Balancing of the rolling force transmitted onto the edging roll 31 is implemented with the aid of an edging roll balancer 40. The edging roll balancer 40 includes a balance crossbeam 41 and a balance cylinder 42. The balance crossbeam 41 is connected to the edging roll chocks 32, 33. The balance cylinder 42 acts via the balance crossbeam 41 and via the connected edging roll chocks 32, 33 upon the double cylinder 50 and applies no working force upon the rolling stock 11. In this embodiment, the double cylinders 50 are respectively associated to the upper and lower edging roll chocks 32 and 33 and in linear force direction.

The double cylinder 50 includes the control adjustment 51 and the rapid adjustment 52 connected therewith. The rod side 51*a* of the control adjustment 51 forms hereby a housing 54*a* for the piston 54 of the rapid adjustment 52. The piston 54 is hereby connected with the housing of the control adjustment 51. The control adjustment 51 is also associated to a piston 53. The piston 53 has a greater diameter than the piston rod 53*a* connected thereto. The piston rod 53*a* forms at the same time the housing 54*a* of the rapid adjustment. Its end, in direction of the edging roll 31, is established by the arrangement in a cylinder head 55. A displacement pick-up 56 is associated to the rapid adjustment 52 and allows determination of the travel path of the pistons 53 and 54. Furthermore, an anti-rotation mechanism 57 is associated to the rapid adjustment 52 in order to prevent a rotation of the pistons 53 and 54 in the respective cylinders about their longitudinal axis.

Figure 2:
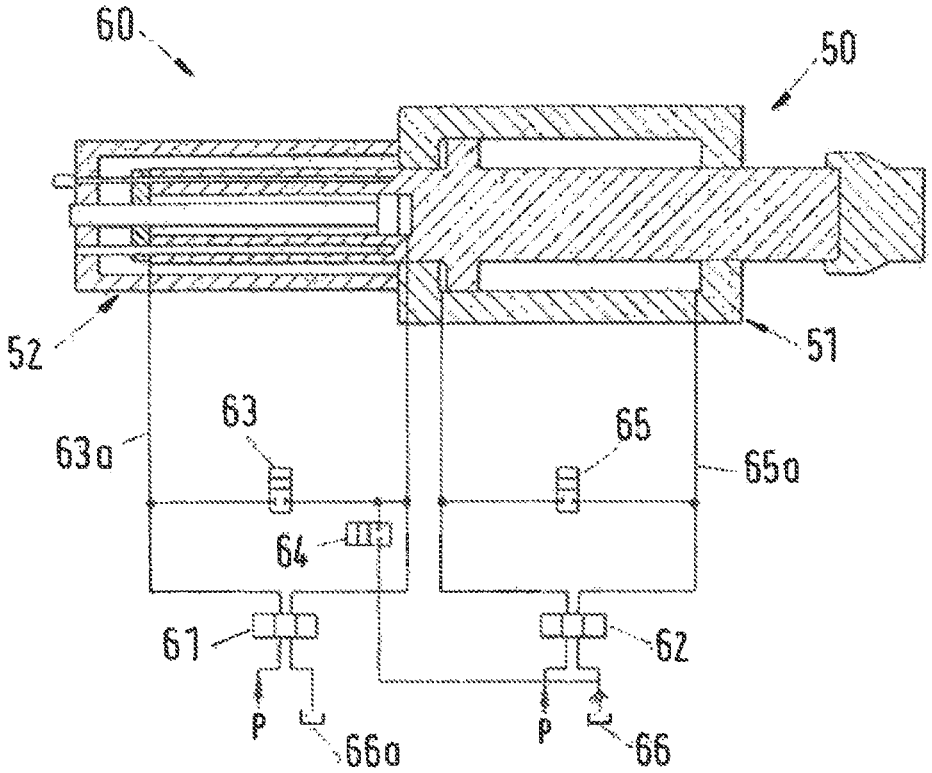
FIG. 2 the illustration of a possible control diagram for a double cylinder of the adjusting cylinder quick-action adjustment shown by sectional view.

FIG. 2 shows a possible control system 60 for the adjusting cylinder quick-action adjustment 9 with double cylinder 50 provided for this. For this purpose, provision is made for a first control valve 61 for the rapid adjustment 52 and at least one second control valve 62 for the control adjustment 51. The control system 60 for the rapid adjustment 52 is established via at least one short-circuit valve 63 which is arranged between the inlet and outlet 63*a* for the hydraulic fluid and thereby virtually directly connect them with one another. In addition, provision is made for a further second short-circuit valve 64, which connects the piston side of the rapid adjustment with a suitably biased system for the purpose of volume compensation. The control system 60 of the control adjustment 51 is also realized via at least one short-circuit valve 65 which connects the inlet and outlet 65*a* with one another. The hydraulic fluid can hereby flow in a circulation and can be collected in a fluid reservoir and fed from there via a pump P into the control system 60.

Figure 3:
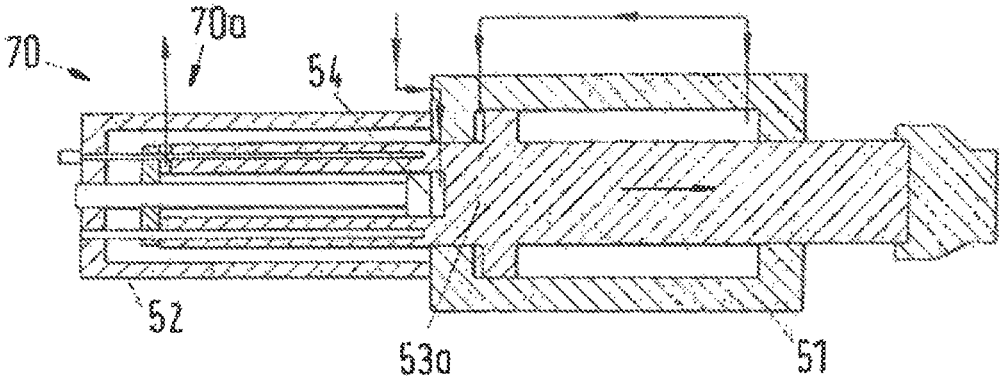
FIG. 3 the schematic sectional illustration of the hydraulic fluid flow when the double cylinder according to FIG. 2 moves out.

FIG. 3 describes the fluid flows during out movement in arrow direction using the rapid adjustment. The control system 60 described in FIG. 2—of the rapid adjustment—connects with the valve 61 the piston volume 54 of the rapid adjustment 52 with the pressure supply and the rod volume 70*a* of the rapid adjustment with the return flow. As a result, the rapid adjustment is actively activated and set in motion. At the same time, the control system 60 connects the two cylinder volumes of the control adjustment 51 via the valve 65 with one another, so that the fluid can be displaced by the movement, caused by the rapid adjustment, directly from one cylinder chamber into the other.

Figure 4:
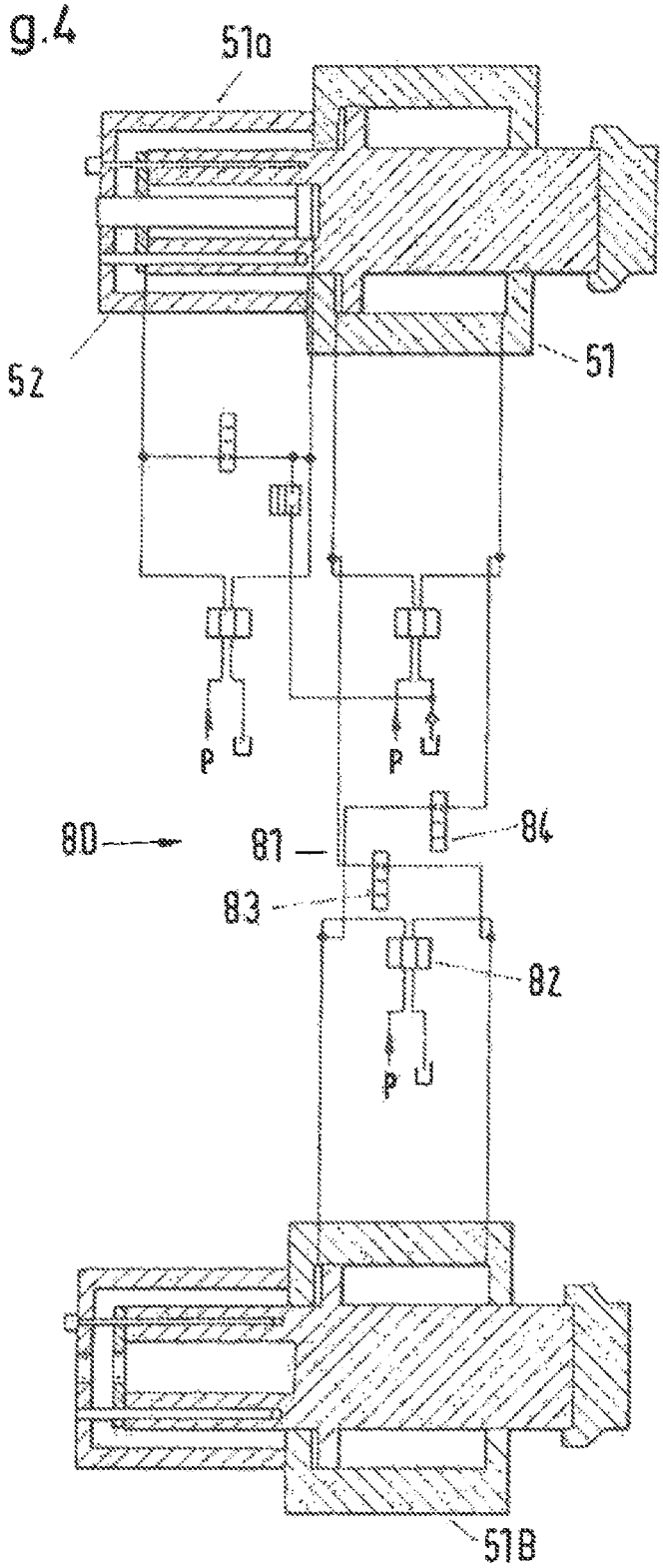
FIG. 4 the schematic illustration of a possible control diagram of the adjusting cylinder quick-action adjustment shown by sectional view and connected to a control cylinder.

FIG. 4 shows a possible control diagram 80 of the double cylinder 50 with a connected control cylinder in a follower control circuit 81. The control system includes at least one additional first short-circuit valve 83 and at least one additional second short-circuit valve 84. As a result, the fluid can be displaced from one cylinder chamber of the control adjustment 51 directly into the oppositely arranged cylinder chamber of the subsequent control adjustment 51B. In the same manner, the displaced fluid of the control adjustment 51B can flow directly into the oppositely arranged cylinder chamber of the control adjustment 51.

As a result of volume differentials in the cylinder chambers or pressure lines, that may be result during manufacture, lacking or excess fluid volume can be fed into or drained from the storage container via the valve 82.

Figure 5:
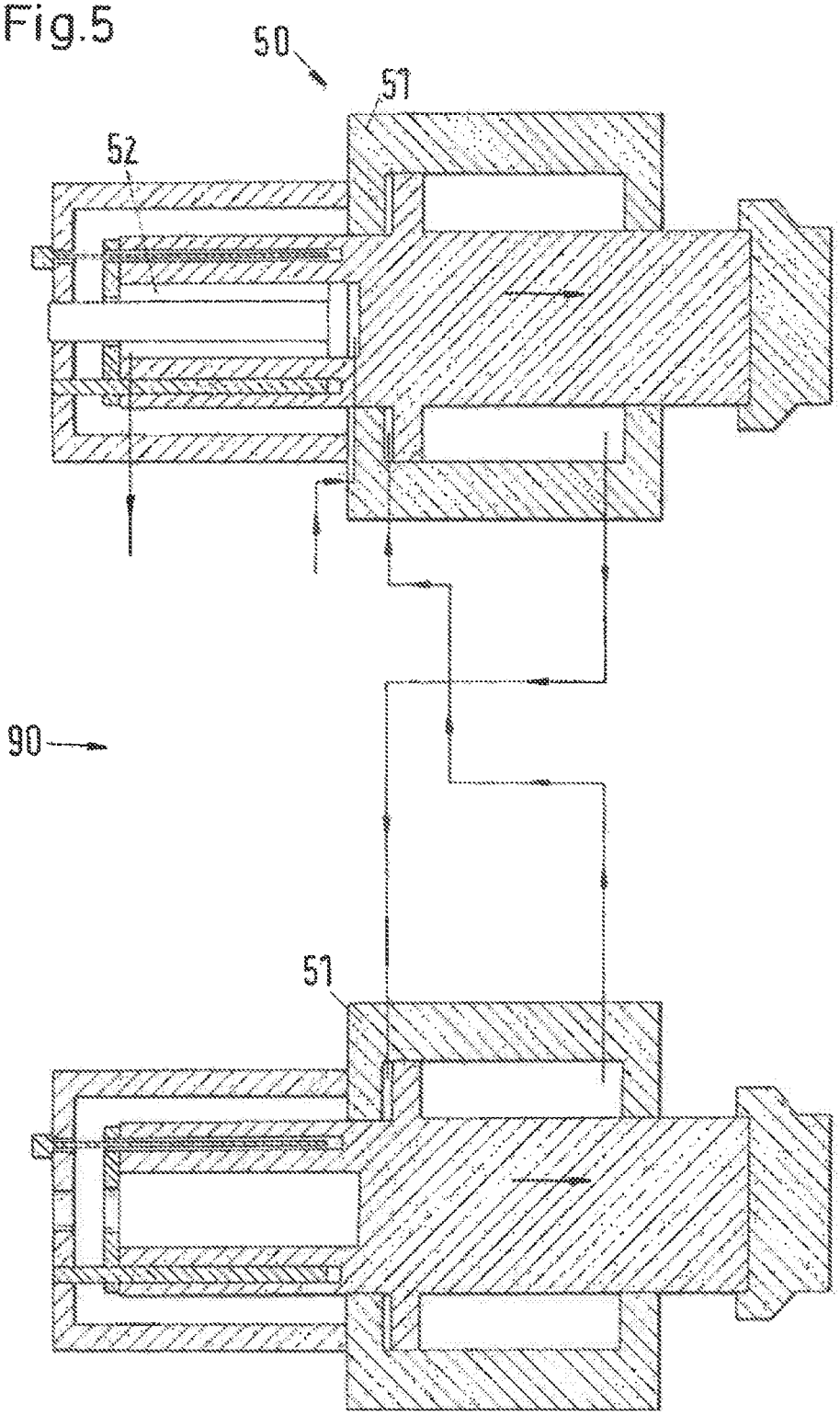
FIG. 5 the schematic sectional illustration of the hydraulic fluid flow when the double cylinder according to FIG. 4 moves out.

FIG. 5 is a schematic illustration of the fluid flow 90 in a follower control circuit when a double cylinder 50, connected with a control adjustment 51 and a rapid adjustment 52, moves out. The term moving out relates to the movement of the control adjustment 51 in direction of the arrow and thus towards the edging roll and in direction of the rolling stock.

LIST OF REFERENCE SIGNS

9 adjusting cylinder quick-action adjustment
10 edger partial view in section
11 rolling stock
20 edger upright
21 edger crosshead
22 edger bar top
23 edger bar bottom
30 edging rolling unit
31 edging roll
32 edging roll chock top
33 edging roll chock bottom
40 edging roll balancer
41 balance crossbeam
42 balance cylinder
50 double cylinder
51 control adjustment
51*a* rod side
51B control adjustment
52 rapid adjustment
53 cylinder piston of the control adjustment
53*a* piston rod
54 cylinder piston of the rapid adjustment

54*a* housing
55 cylinder head
56 displacement pick-up
57 anti-rotation mechanism
60 possible control diagram of a double cylinder
61 control valve rapid adjustment
62 control valve control adjustment
63 first short-circuit valve
63*a* inlet and outlet (pressure lines)
64 second short-circuit valve
65 short-circuit valve control adjustment
66, 66*a* fluid reservoir
70 fluid flow during out movement for (60) in the operating mode rapid adjustment
80 control diagram of the double cylinder with a movable control cylinder
81 follower control circuit
82 control valve control adjustment
83 first short-circuit valve in follower control circuit
84 second short-circuit valve in follower control circuit
90 fluid flow during out movement for (80) of a double cylinder in the operating mode rapid adjustment
P pump

The invention claimed is:

1. An edging stand, comprising:

an edger upright;

an edging roll chock;

an edging roll rotatably mounted in the edging roll chock; and an adjusting cylinder quick-action adjustment for executing a long, rapid stroke movement, said adjusting cylinder quick-action adjustment being mounted in the edger upright and configured to exert a force required for an edging process, said adjusting cylinder quick-action adjustment including on each side of the edging upright a double cylinder, with the double cylinder comprising a rapid adjustment cylinder and a control adjustment cylinder which are coupled to one another and separately controllable for rapid adjustment and for control adjustment of the edging roll, a first cylinder piston received in one of the cylinders and configured to act on the edging roll via the edging roll chock against a rolling stock for adjustment against the rolling stock on both sides, with the adjustment of the edging roll being actuatable on each side hydraulically by a fluid, and a second cylinder piston received in the other one of the cylinders, said first and second cylinder pistons having a same stroke travel.

2. The edging stand of claim 1, wherein the second cylinder piston and a housing of the control adjustment cylinder are connected with a same fixed bank of the edger upright.

3. The edging stand of claim 2, wherein the second cylinder piston is connected with the first cylinder piston, with a housing of the rapid adjustment cylinder being connected with a same fixed bank of the housing of the control adjustment cylinder.

4. The edging stand of claim 1, wherein the first cylinder piston includes a piston rod and is configured to execute the control adjustment, said piston rod being made in one piece with a housing of the rapid adjustment cylinder.

5. The edging stand of claim 1, wherein the first cylinder piston includes a piston rod and is configured to execute the control adjustment, said piston rod being connected with a housing of the rapid adjustment cylinder, wherein the second cylinder piston is configured to execute the rapid adjustment and is connected with a same fixed bank of a housing of the control adjustment cylinder.

6. The edging stand of claim 1, wherein the second cylinder piston is configured to execute the rapid adjustment, wherein the rapid adjustment cylinder and the control adjustment cylinder are configured for separate activation from one another, with a movement of a housing of the rapid adjustment cylinder or a movement of the second cylinder piston, as triggered by the activation, causes a movement of the first cylinder piston of the control adjustment cylinder.

7. The edging stand of claim 1, wherein the rapid adjustment has an adjustment speed which is greater than an adjustment speed of the control adjustment by a multiple as a result of surface ratios of the first and second cylinder pistons at same volumetric flow rate of the fluid.

8. The edging stand of claim 1, wherein the double cylinder includes a non-active part which is configured to conduct a displaced hydraulic fluid volume during an adjusting movement into a respectively other cylinder chamber, wherein lacking fluid volume is replenishable and excess fluid volume is drainable.

9. The edging stand of claim 1, wherein the first cylinder piston of the control adjustment cylinder of the double cylinder is configured as a piston with two piston rods pointing in opposite directions.

10. The edging stand of claim 9, wherein the piston rods have a same diameter.

11. The edging stand of claim 1, wherein the second cylinder piston is configured to execute the rapid adjustment, said second cylinder piston of the double cylinder being configured as a piston and two piston rods pointing in opposite directions.

12. The edging stand of claim 11, wherein the piston rods have a same diameter.

13. The edging stand of claim 1, wherein the cylinders of the double cylinder are structurally interleaved within one another to realize a compact construction.

14. The edging stand of claim 1, wherein the first cylinder piston of the control adjustment cylinder forms a housing or the cylinder of the rapid adjustment cylinder.

15. The edging stand of claim 1, further comprising a cylinder head associated to the control adjustment cylinder to reduce a radial force upon an adjustment from a leading pass impact.

16. The edging stand of claim 1, wherein the second cylinder piston is configured to execute the rapid adjustment, said first and second cylinder pistons] being equipped with an anti-rotation mechanism.

17. The edging stand of claim 1, further comprising a distance measuring system associated to each of the control adjustment cylinder and the rapid adjustment cylinder.

18. The edging stand of claim 1, further comprising valves configured for separate operation for activation of the cylinders of the double cylinder.

19. The edging stand of claim 18, wherein the valves are configured as servo valves or proportional valves or directional control valves.

* * * * *